US006646619B2

(12) United States Patent
Johnson et al.

(10) Patent No.: US 6,646,619 B2
(45) Date of Patent: Nov. 11, 2003

(54) BROADBAND ANTENNA ASSEMBLY OF MATCHING CIRCUITRY AND GROUND PLANE CONDUCTIVE RADIATING ELEMENT

(75) Inventors: Greg Johnson, Aptos, CA (US); Robert Hill, Salinas, CA (US); Don Keilen, Sparks, NV (US)

(73) Assignee: Tyco Electronics Logistics AG (CH)

( * ) Notice: Subject to any disclaimer, the term of this patent is extended or adjusted under 35 U.S.C. 154(b) by 134 days.

(21) Appl. No.: 09/940,827

(22) Filed: Aug. 27, 2001

(65) Prior Publication Data

US 2002/0033772 A1 Mar. 21, 2002

Related U.S. Application Data

(63) Continuation of application No. PCT/US00/04895, filed on Feb. 25, 2000.
(60) Provisional application No. 60/121,989, filed on Feb. 27, 1999.

(51) Int. Cl.[7] ..... H01Q 1/38
(52) U.S. Cl. ..... 343/860; 343/702
(58) Field of Search ..... 343/700 MS, 702, 343/749, 752, 860, 795, 793

(56) References Cited

U.S. PATENT DOCUMENTS

| | | | | |
|---|---|---|---|---|
| 4,095,227 A | * | 6/1978 | Kaloi | 343/700 MS |
| 5,233,360 A | | 8/1993 | Kuroda et al. | 343/700 |
| 6,239,765 B1 | * | 5/2001 | Johnson et al. | 343/795 |

* cited by examiner

*Primary Examiner*—Don Wong
*Assistant Examiner*—James Clinger
(74) *Attorney, Agent, or Firm*—Fulbright & Jaworski L.L.P.

(57) ABSTRACT

An antenna device is disclosed, which is intended for a portable radio communication device. The communication device includes a signal generating component having a signal output, said output defining a signal generating circuit impedance. The antenna device includes a substantially planar conductor having an associated impedance and preferably extending in a first dimension greater than approximately one-quarter of a predetermined operational wavelength. The antenna device further includes a matching network which is coupled to the signal generating output. The matching network having a substantially planar dielectric substrate and a conductive meander element and a conductive trace element, wherein said matching network transforms the impedance of the signal generating component to approximate the impedance of the planar conductor element.

9 Claims, 6 Drawing Sheets

BROADBAND ANTENNA ASSEMBLY OF MATCHING CIRCUITRY AND GROUND PLANE CONDUCTIVE RADIATING ELEMENT

CROSS REFERENCE TO RELATED APPLICATION

This application claims the benefit of priority as a continuation pursuant to 35 U.S.C. §119 of copending PCT application Ser. No. PCT/US00/04895 filed Feb. 25, 2000, which application claimed the benefit of priority pursuant to 35 USC §119(e)(1) from the provisional patent application filed pursuant to 35 USC §111(b): as Ser. No. 60/121,989 on Feb. 27, 1999.

TECHNICAL FIELD OF THE INVENTION

The present invention relates to a wireless communication device and more particularly to an antenna assembly having a matching impedance network wherein a conductive planar element may function as both the primary radiating element of the antenna and the ground network of the device.

BACKGROUND OF THE INVENTION

Techniques for end feeding a dipole antenna with an unbalanced 50 ohm feedline are known, including a ¼ wave matching stub and a parallel LC circuit. Both the matching stub and parallel LC circuit act as impedance transformers between 50 ohms and the much higher impedance at the end of a dipole. The current invention does not contain a ¼-wave stub nor a parallel LC circuit.

SUMMARY OF THE PRESENT INVENTION

Disclosed herein are wireless communication devices having efficient antenna structures including a matching impedance network. Wireless communication devices may include cellular telephones, PCS devices, PDA's, etc. The matching network and an associated conductor panel define an antenna structure. In one embodiment, the conductor panel may be a ground plane of a printed wiring board of the wireless communication device. Additional advantages will be described with particular reference to the appended drawings.

Unique methods for edge- or end-feeding a conductor panel to create a broadband antenna are disclosed herein. A novel matching circuit structure provides a feed system for operatively coupling the wireless device's signal generation circuitry to an end of the conductive plate resulting in primary radio frequency transmission from the conductor panel. The new feed system has a 50 ohm unbalanced input, and a single output connection point for the conducting plate.

As described herein, the conductor panel is caused to radiate RF signals by application of the matching network. The RF signal of the conductor panel is linearly polarized parallel to the longest dimension of the panel. The conductor panel may be generally rectangular, with a longest dimension of ¼ wavelength minimum at the lowest frequency of operation. The dimension perpendicular to the longest dimension is not critical, and may vary from 0.005 wavelength to 0.25 wavelength. The conductor panel may desirably take the form of the common ground traces of a printed wiring board. The printed wiring board (PWB) of a cellphone or other wireless device provides a suitable conductor "panel".

Additionally, the matching network may be fabricated using standard printed circuit techniques and materials, making it inexpensive and suitable for mass production. The matching network may be disposed relative to another PWB, using commonly known fabrication techniques and practices. The matching network is relatively small in size and weight, and may be installed entirely within the interior of a cellphone or other wireless device (eliminating the necessity of an external antenna component and the potential for damage thereof).

As further discussed, the matching network may be connected between the 50 ohm antenna feed port of a cellphone or wireless device and the device's ground plane to form an internal broadband antenna system having superior physical and operational characteristics.

An additional aspect of the present invention is to provide a broadband, compact, and lightweight matching network to interconnect low and high impedances is provided, having an operational bandwidth of 8–10% of the center frequency.

Yet another aspect of the present invention is the matching network to feed a conductor, such as a rectangular planar element, and cause it to operate as an efficient antenna over the bandwidth of the matching network.

Another aspect of the present invention provides that the dimensions of the antenna planar radiating conductor are much less critical than when using other feed techniques. Importantly, the antenna radiating conductor may be the common ground traces of a cellphone or other wireless device's PWB. The matching network's size is such that it can be installed within the interior of a typical cellphone or other wireless device.

Yet another aspect of the present invention provides a matching network which may be manufactured using ordinary printed circuit technology, to provide a low cost antenna system for cellphones and other wireless devices. Particular embodiments of the matching network may result in an antenna exhibiting front-to-back rejection, which may be useful for reducing power lost into the user's body.

Still other objects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawings and description are to be regarded as illustrative in nature, and not as restrictive.

BRIEF DESCRIPTION OF THE DRAWINGS

Preferred embodiments of the invention will be described in detail hereinafter with reference to the accompanying drawings, in which like reference numeral refer to like elements throughout, wherein.

A DESCRIPTION OF PREFERRED EMBODIMENTS OF THE PRESENT INVENTION

FIGS. 1–6 relate to a first group of antenna assembly according to the present invention, said antenna exhibiting a particular front-to-back rejection characteristic. Operation over a frequency range from 1850–1990 Mhz, the American PCS cellular telephone band has been realized. Dimensions for operations over other frequency ranges are obtainable through well known scaling and/or conversion techniques.

Figure 1:
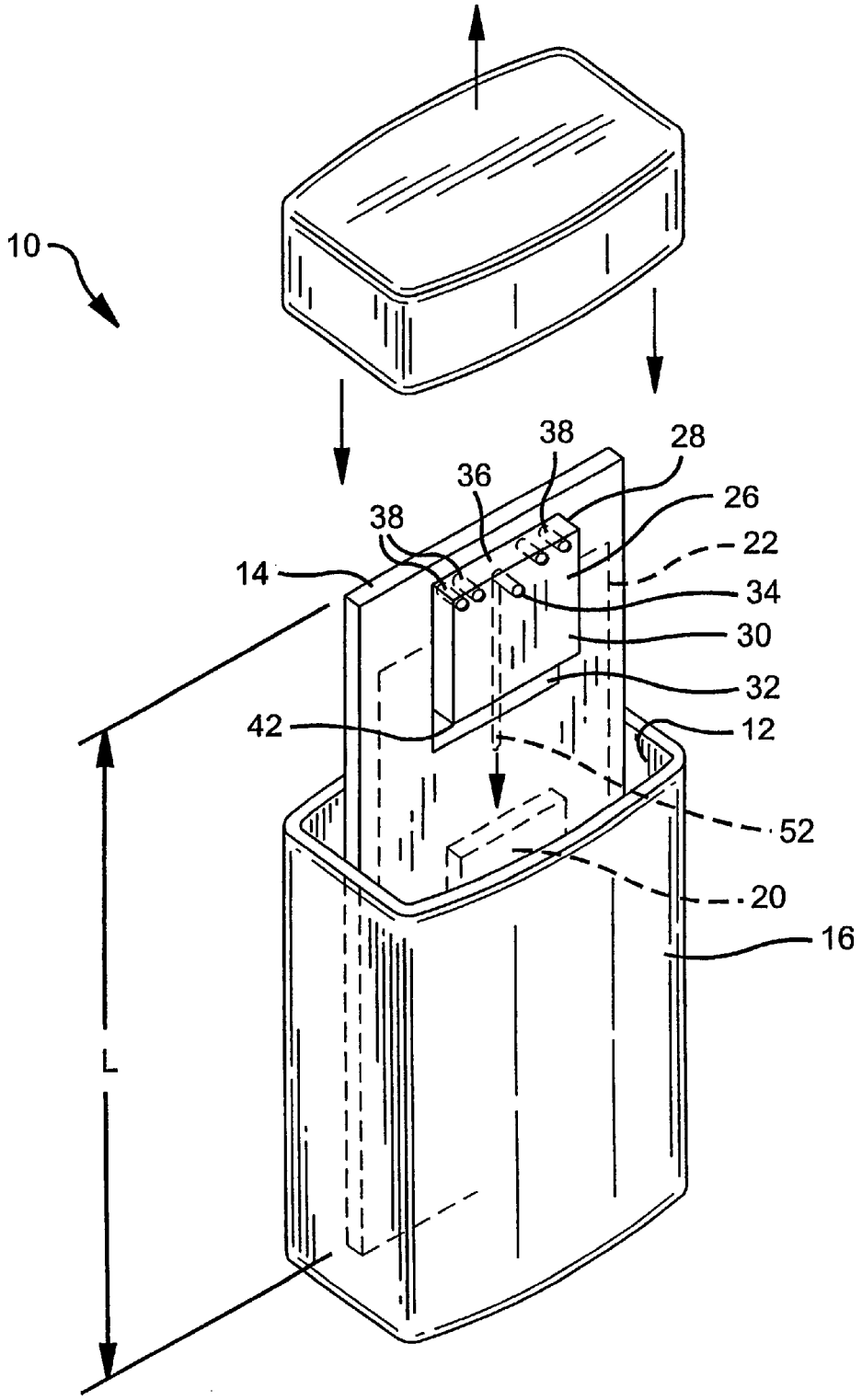
FIG. 1 is a perspective view of a wireless communication device, having an antenna assembly including a matching network and conductor panel, according to the present invention.
Figure 2:
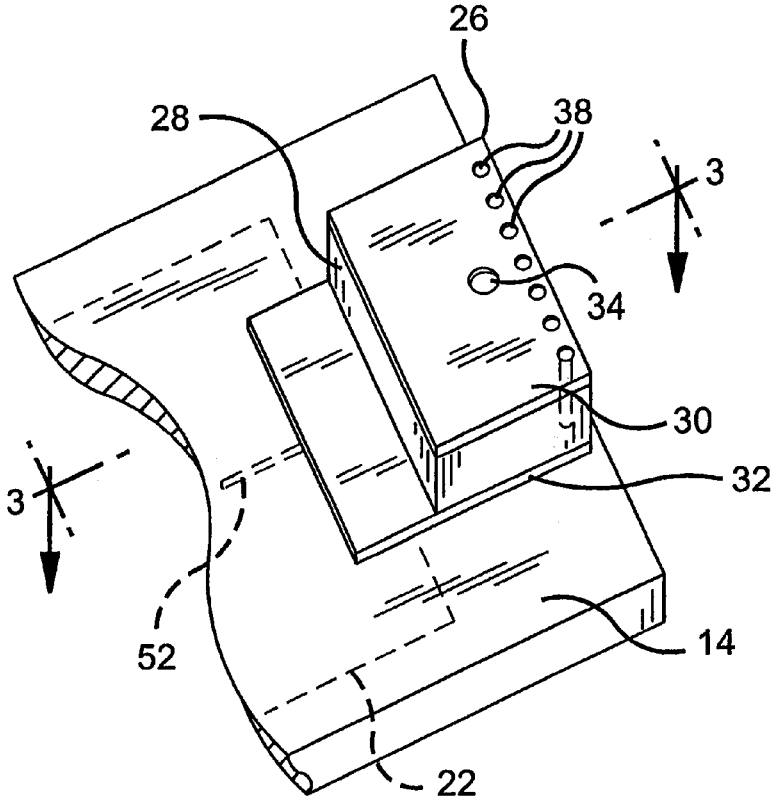
FIG. 2 is a detailed perspective of the matching network and conductor panel of FIG. 1.
Figure 3:
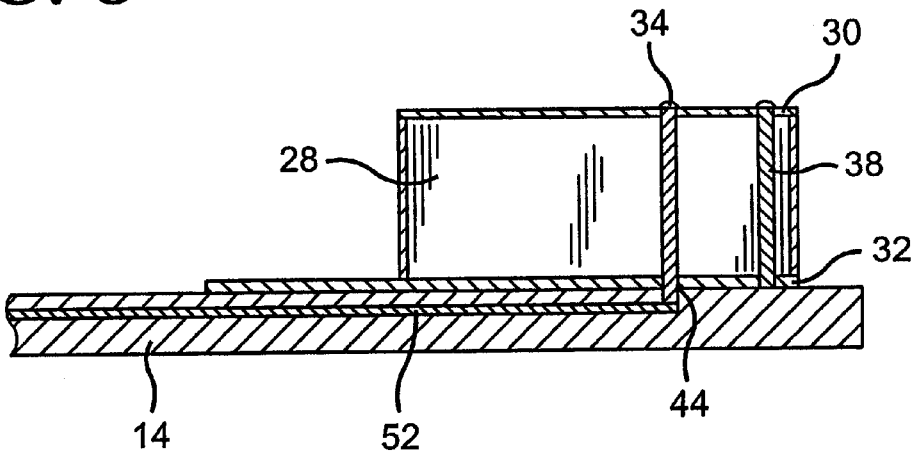
FIG. 3 is a cross sectional view of the matching network and conductor panel of FIG. 2, taken along lines 3—3.

FIG. 1 provides a wireless communication device 10 having an interior cavity 12 for receiving one or more planar elements, such as the printed wiring board 14 of the device 10. Communication device has a front side, closer to the user during communication operation, and an opposed rear side 16. Printed wiring board 14 may have disposed thereupon various componentry, including a signal generating component 20. Defined upon at least a portion of the printed wiring board 14 is a ground plane structure 22. Printed wiring board 14 is illustrated as substantially planar and rectangular. Alternatively, printed wiring board 14 may be defined by more complex surfaces. The printed wiring board 14 preferably has an electrical length, 'L' of approximately one-quarter of a wavelength within the range of operational frequencies. Ground plane structure 22 provides a preferred planar conductor "panel" component of the antenna assembly of the wireless device 10. Alternatively, a separate conductor panel (not shown) may be used to practice the present invention.

Disposed proximate the rear side 16 of the printed wiring board is a matching impedance device 26 according to the present invention. The matching device 26 is disposed near the uppermost edge of the printed wiring board 14 (and adjacent the top of the wireless communication 10 during intended use). In this orientation, the matching circuit 26 is minimally effected by the user's hand during intended use. Matching impedance device 26 includes a dielectric member 28 having a dielectric constant of approximately 3 and a thickness of 0.093 inches. The dielectric member 28 may have a dielectric constant in the range of 2–20. The dimensions of the matching network 26 will vary from those given according to the square root of the dielectric constant.

An upper conductor element 30 and a lower conductor element 32 are disposed upon major surfaces of the dielectric member 28. A feedpoint 34 is provided at the upper conductor 30. The upper conductor 30 is coupled to the signal generating component 20 at the feedpoint 34. An electrical short is provided between the upper conductor 30 and the lower conductor 32 proximate an upper edge 36. In this embodiment, the short is provided via a number of plated through-holes 38. Through holes 38 are preferably aligned along the upper edge of the matching circuit 26. Lower conductor 32 is extended at another edge 42 to provide a connection surface to the ground plane 22 of the wireless communication device 10. The lower conductor 32 of the matching network 26 is operatively coupled to the ground plane 22 of the printed wiring board 14. The coupling between the lower conductor 32 and the ground plane 22 may be made in a variety of manners, such as direct contact, conductive adhesives, soldering, etc. The matching network 26 may be adjacent a rear surface of the printed wiring board 14 or may be supported a distance away from the printed wiring board 14.

Figure 6:
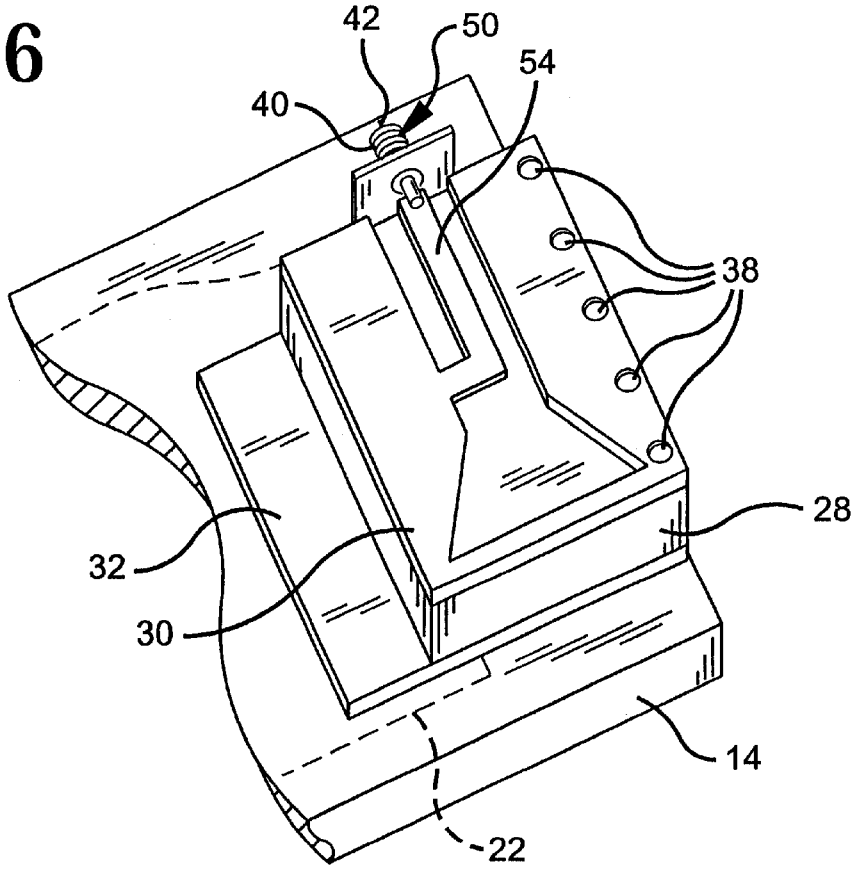
FIG. 6 is a perspective view of another embodiment of a matching network according to the present invention.

Upper conductor 30 may be operatively coupled to the signal generating component 20 of the wireless device 10 via a standard 50 ohm RF connector 50 having its outer shield 40 electrically coupled to the lower conductor 32 and its center conductor 42 passing through an aperture 44 in the bottom conductor 32 and dielectric member 28 to make an electrical connection to the upper conductor 30. FIG. 6 illustrates another RF connector 50 feed embodiment. Alternatively, and as illustrated in FIGS. 1–4, upper conductor 30 is operatively coupled to the signal generating component 20 via a microstrip line 52. Microstrip line 52 is operatively coupled to the signal generating component 20 and is disposed upon the printed wiring board 14 and passes through an aperture 44 of the lower conductor element 32 and is coupled to the upper conductor 30 of the impedance matching device 26.

Figure 4:
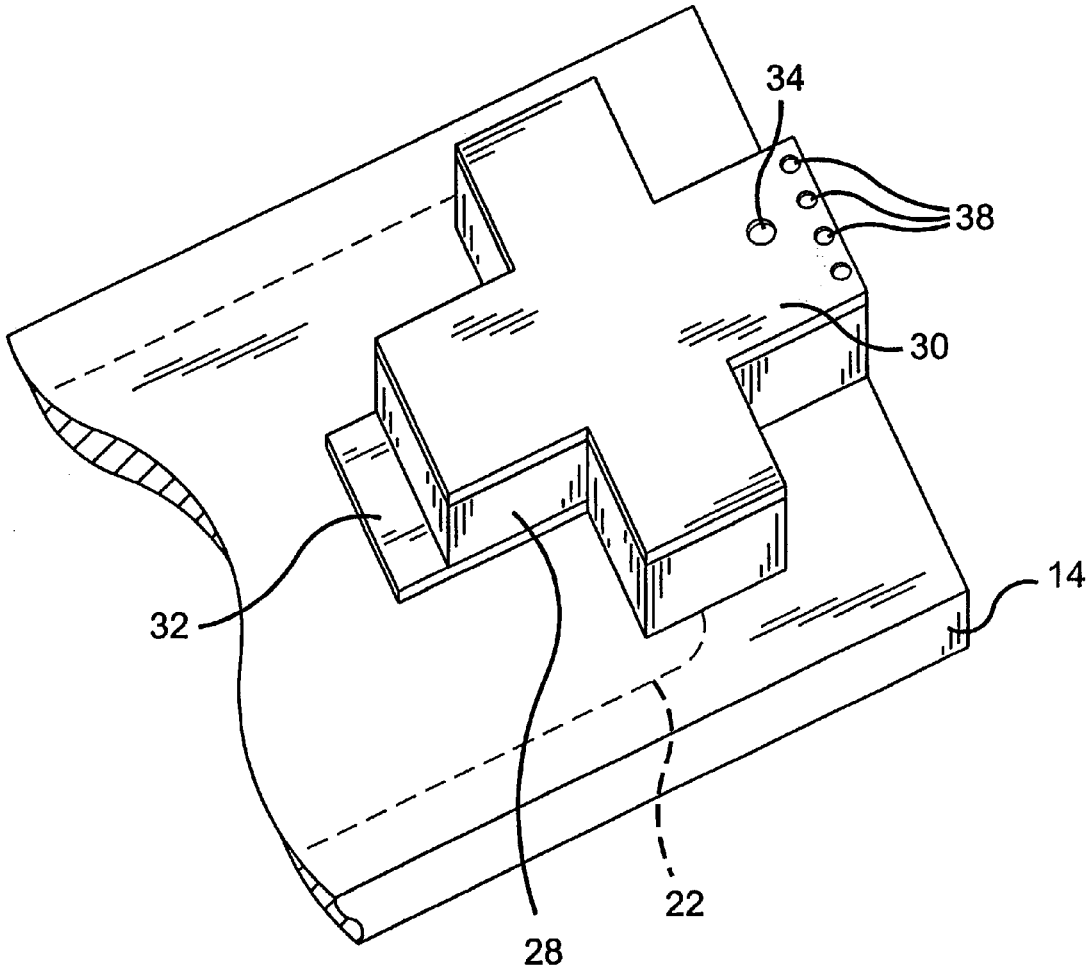
FIG. 4 is a perspective view of another embodiment of a matching network according to the present invention.
Figure 5:
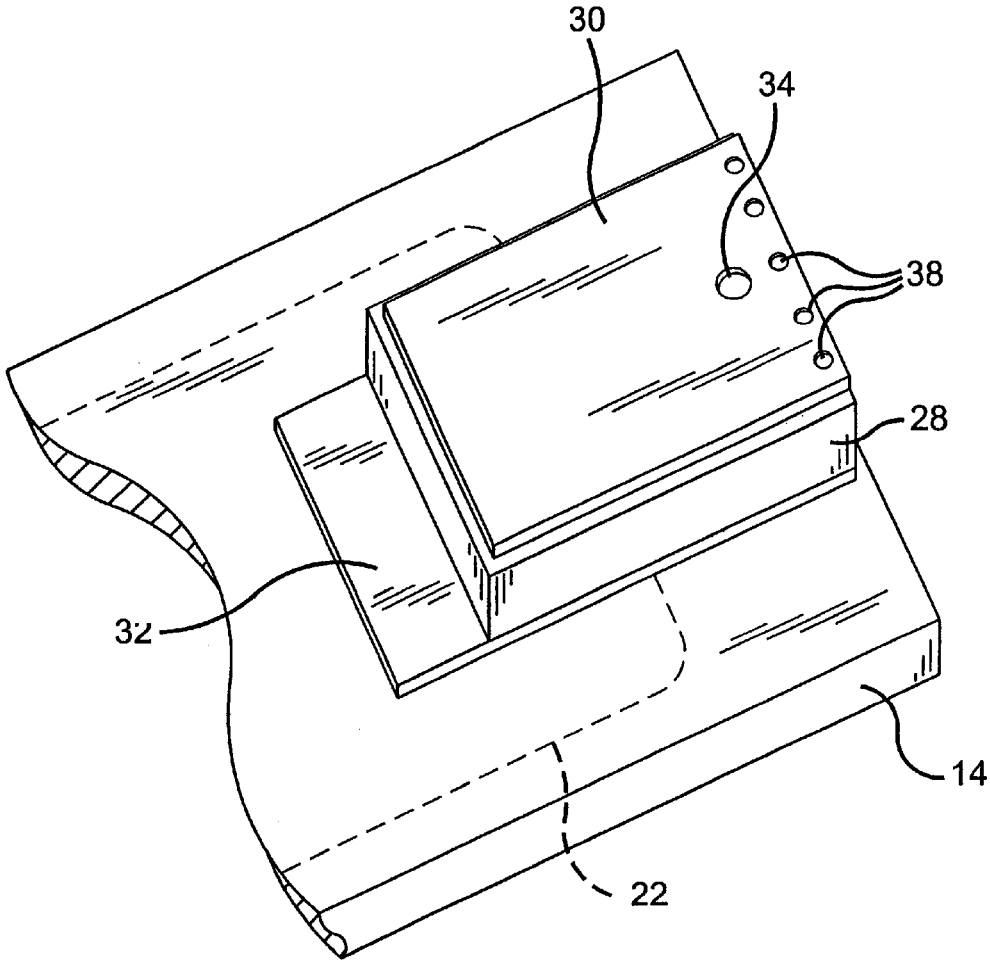
FIG. 5 is a perspective view of another embodiment of a matching network according to the present invention.

FIGS. 4 and 5 illustrate additional preferred embodiments of the present invention. The matching network 26 is disposed generally parallel to the conductive plate member (ground plane). An upper edge of the matching circuit and the conductive plate member are substantially common. In FIG. 4, the upper conductor disposed upon the dielectric substrate is substantially coexistent with the upper surface of the dielectric substrate. In comparison, the upper conductor of FIG. 5 is disposed upon a smaller portion of the upper surface of the dielectric substrate. An upper edge of the matching circuit and the printed wiring board are substantially common.

FIG. 6 illustrates another embodiment of the antenna assembly according to the present invention. The matching circuit 26 includes a configured trace element 54 disposed upon an upper surface of the dielectric member 28. Configured trace element 54 includes a tapered element. Linear or other shaped elements may also be utilized in the practice of the invention. The configured trace element 54 may be rendered upon the upper surface of a plated dielectric member 28 through known PWB fabrication techniques. The matching network 26 is operatively coupled to the wireless communication device 10 through a coax feedline system. The center conductor 42 of the coax feedline is coupled to the upper trace 54 of the matching network 26, and the shield conductor 40 of the coax feedline is coupled to the lower conducting panel 32 and the ground plane of the printed wiring board 14 of the wireless device 10 or a separate conducting panel.

Figure 7:
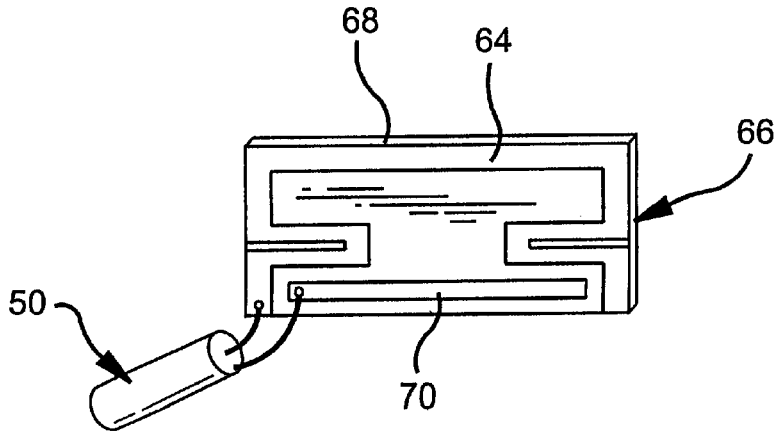
FIG. 7 is a diagrammatic elevational view of another embodiment of a matching network according to the present invention having a meander.
Figure 8:
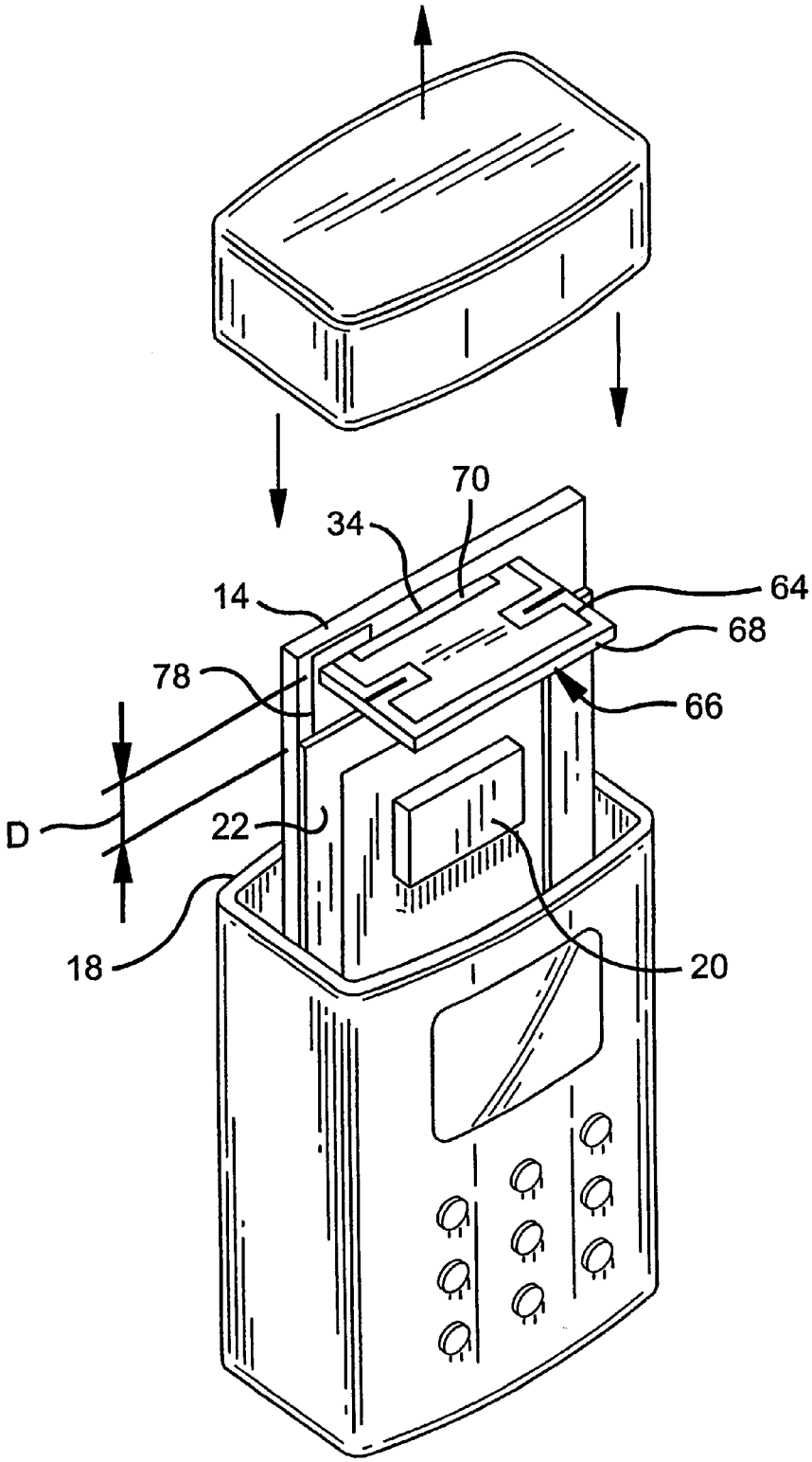
FIG. 8 is a perspective view of a wireless communication device incorporating the matching network of FIG. 7.

Referring now to FIGS. 7 and 8, another embodiment of an matching network 26 is illustrated. The matching network 66 includes a quarter-wavelength conductive element 64 disposed upon a major surface of the planar dielectric member 68. The quarter-wavelength conductive element 64 may be a serpentine or meandering conductive trace upon the surface of the dielectric member 68. It may be appreciated that alternative shapes or geometries may be implemented for the quarter-wave conductive trace 64. In the illustrated embodiment, the conductive element 64 may be disposed proximate the perimeter of the dielectric member 68. An additional conductor element 70, separate from the quarter-wavelength conductive element, is disposed upon the dielectric element 68. As illustrated in FIG. 8, conductor element 70 is coupled to the ground plane 22 of printed wiring board 14 via a conductor line 78 which is disposed upon the printed wiring board. Referring particularly to FIG. 8, the quarter-wave conductive element 64 and the additional conductor element 70 of the matching network 66 are disposed upon the upper major surface of the dielectric member 68. Other orientations of the quarter-wave conductive element 64 and the additional conductor element 70 may be practicable, including having these elements 64, 70 on opposed major surfaces of the dielectric substrate member 68. Importantly, a predetermined offset distance, 'D', is maintained between the matching network 66 and the ground plane 22 of the printed wiring board.

In the illustrated embodiment, the matching network 66 is disposed in an orthogonal orientation relative to the ground plane member 22. Additionally, the matching network 66 is disposed near the top of the wireless communication device 10 and away from a user's hand during intended operation thereof. Alternatively, the matching network 66 may be in a parallel orientation (not shown) relative to the conductive panel member 70. In this regard, the matching network may be disposed upon a portion of the printed wiring board 14, though maintained a predetermined isolation distance away from the conductive panel member 70.

Although particular embodiments of the invention have been illustrated in the accompanying Drawings and described in the foregoing Detailed Description, it will be understood that the invention is not limited only to the embodiments disclosed, but is intended to embrace any alternatives, equivalents, or modifications falling within the scope of the invention as defined by the following claims.

We claim:

1. A wireless communication device for receiving and transmitting a communication signal, said signal having an associated wavelength, said device comprising:

a signal generating component having a signal output, said output defining a signal generating circuit impedance;

a substantially planar conductor element operatively coupled to the signal generating component, said planar conductor element extending in a first dimension of approximately one-quarter of the wavelength, said planar conductor element having an associated impedance, said planar conductor element being formed on a printed wiring board as the ground plane of the wireless communication device and being an active radiating element of the device; and a matching network disposed in relation to the signal generating component and the planar conductor element and operatively coupled to the signal generating output, said matching network having a substantially planar dielectric substrate and a first conductive layer disposed upon a first major surface of the dielectric substrate, and a second conductive layer disposed upon a second major surface of the dielectric substrate, said first and second conductive layers being conductively coupled together, said matching network transforming the impedance of the signal generating component to approximate the impedance of the planar conductor element.

2. A wireless communication device according to claim 1, wherein the matching network is disposed proximate an edge of the planar conductor element.

3. A wireless communication device according to claim 2, wherein the first and second conductive layers of the matching network are substantially planar, and said first and second conductive layers of the matching network being substantially parallel to the planar conductor element.

4. A wireless communication device for receiving and transmitting a communication signal, said signal having an associated wavelength, said device comprising:

a signal generating component having a signal output, said output defining a signal generating circuit impedance;

a substantially planar conductor element operatively coupled to the signal generating component, said planar conductor element extending in a first dimension of approximately one-quarter of the wavelength, said planar conductor element having an associated impedance, said planar conductor element being formed on a printed wiring board as the ground plane of the wireless communication device and being an active radiating element of the device; and a matching network disposed in relation to the signal generating component and the planar conductor element and operatively coupled to the signal generating output, said matching network having a substantially planar dielectric substrate and a conductive meander element provided upon a first major surface and an additional conductor element provided upon a second major surface, said meander element and said conductor element being electrically coupled together, said matching network transforming the impedance of the signal generating component to approximate the impedance of the planar conductor element.

5. A wireless communication device according to claim 4, wherein said conductive meander element has a length of approximately one quarter of the wavelength.

6. A wireless communication device according to claim 4, wherein the conductive meander element is disposed proximate a perimeter of the dielectric substrate.

7. A wireless communication device according to claim 4, wherein the signal generating component is coupled proximate an end of the meander element.

8. A wireless communication device according to claim 4, wherein the matching network is disposed proximate an edge of the planar conductor element.

9. A wireless communication device according to claim 4, wherein the conductive meander element and the additional conductor element are disposed upon opposed major surfaces of the dielectric substrate.

* * * * *